US008981880B2

(12) United States Patent
Politi

(10) Patent No.: US 8,981,880 B2
(45) Date of Patent: Mar. 17, 2015

(54) WAVEGUIDE BAND-PASS FILTER WITH PSEUDO-ELLIPTIC RESPONSE

(75) Inventor: Marco Politi, Milan (IT)

(73) Assignee: Politecnico di Milano, Milan (IT)

( * ) Notice: Subject to any disclaimer, the term of this patent is extended or adjusted under 35 U.S.C. 154(b) by 255 days.

(21) Appl. No.: 13/809,109

(22) PCT Filed: Jul. 9, 2010

(86) PCT No.: PCT/IT2010/000306

§ 371 (c)(1),
(2), (4) Date: Feb. 28, 2013

(87) PCT Pub. No.: WO2012/004818

PCT Pub. Date: Jan. 12, 2012

(65) Prior Publication Data

US 2013/0154772 A1 Jun. 20, 2013

(51) Int. Cl.
*H01P 1/20* (2006.01)
*H01P 1/208* (2006.01)
*H01P 1/207* (2006.01)

(52) U.S. Cl.
CPC ..... *H01P 1/208* (2013.01); *H01P 1/207* (2013.01)
USPC ..... 333/212; 33/208; 33/209

(58) Field of Classification Search
USPC ..... 333/201–212
See application file for complete search history.

(56) References Cited

U.S. PATENT DOCUMENTS 6,118,978 A * 9/2000 Ihmels ..... 455/12.1
8,067,997 B2 * 11/2011 Melde et al. ..... 333/17.3
8,595,924 B2 * 12/2013 McKinzie, III ..... 29/846
8,604,982 B2 * 12/2013 Achour et al. ..... 343/700 MS
2005/0073379 A1 4/2005 Helme et al.
2006/0066421 A1 3/2006 Lo Hine Tong et al.
2007/0262834 A1 * 11/2007 Albacete et al. ..... 333/204
2007/0272557 A1 * 11/2007 Matthews ..... 205/46
2010/0180437 A1 * 7/2010 McKinzie, III ..... 29/825
2011/0079516 A1 * 4/2011 Matthews ..... 205/339

FOREIGN PATENT DOCUMENTS

WO 03/065496 A1 8/2003
WO 2004/054031 A1 6/2004
WO 2009/150689 A1 12/2009

OTHER PUBLICATIONS

George Goussetis et al., "Compact Ridged Waveguide Filters with Improved Stopband Performance", IEEE MTT-S International Microwave Symposium Digest, 2003, pp. 953-956, vol. 2, Philadelphia, PA.

(Continued)

*Primary Examiner* — Brandon S Cole
(74) *Attorney, Agent, or Firm* — Sughrue Mion, PLLC

(57) ABSTRACT

A waveguide band-pass filter is disclosed comprising: an input/output gate for a signal; a first inductive discontinuity coupling device; a second inductive discontinuity coupling device and a first waveguide resonator segment coupled to said input/output gate and interposed between the first and the second coupling devices. At least one of the first and the second coupling devices includes at least a resonant coupling structure which extends in the waveguide with a reduced height relative to a height of the first resonator segment and it is shaped for inputting a zero in a transmission frequency response of the filter.

15 Claims, 15 Drawing Sheets

(56) References Cited

OTHER PUBLICATIONS

W. Menzel et al., "Planar Integrated Waveguide Diplexer for Low-Loss Millimeter-Wave Applications", pp. 676-680 in Proc. of the 27th European Microwave Conference, Jerusalem, Sep. 1997.

George L. Matthaei et al., "Microwave Filters, Impedance-Matching Networks, and Coupling Structures" 1964, pp. 421-459, McGraw Hill, Inc.

Jose Vicente Morro Ros et al., "Fast Automated Design of Waveguide Filters Using Aggressive Space Mapping With a New Segmentation Strategy and a Hybrid Optimization Algorithm", IEEE Transactions on Microwave Theory and Techniques, Apr. 1, 2005, pp. 1130-1142, vol. 53, No. 4.

Roland Gesche et al., "Two Cylindrical Obstacles in a Rectangular Waveguide-Resonances and Filter Applications", IEEE Transactions on Microwave Theory and Techniques , Jun. 1, 1989, vol. 37, No. 6, pp. 962-968.

International Search Report mailed Mar. 23, 2011.

* cited by examiner

WAVEGUIDE BAND-PASS FILTER WITH PSEUDO-ELLIPTIC RESPONSE

CROSS REFERENCE TO RELATED APPLICATIONS

This application is a National Stage of International Application No. PCT/IT2010/000306 filed Jul. 9, 2010, the contents of all of which are incorporated herein by reference in their entirety.

FIELD OF THE INVENTION

The present invention refers to the field of waveguides and in particular to waveguide band-pass filters.

PRIOR ART

Waveguide band-pass filters are known which comprise a cascade of waveguide segments whose length is about half of the central wavelength of the filter ($\lambda/2$) or multiples of such a value which act as resonators and are coupled to each other (and to input/output guides) by discontinuities such as, typically, diaphragm-structures. These coupling-discontinuities present an equivalent circuit having a shunt reactance. The reactance value, usually inductive, determines the entity of the coupling between the resonating guide segments.

The synthesis of such waveguide filters, called "filters with directly-coupled resonator" is analysed in G. L. Matthaei, L. Young e E. M. T. Jones, "Microwave filters, Impedance-Matching Networks, and Coupling Structures" ed. McGraw Hill, 1964.

U.S. Pat. No. 7,391,287 discloses a "H-plane" waveguide filter having transmission zeros. The article by W. Maenzel, F. Alessandri, A. Plattner, and J. Bornemann, "Planar integrated waveguide diplexer for low-loss millimeter-wave applications", in Proc. of the 27th European Microwave Conf., Jerusalem, September 1997, pp. 676-680 illustrates the use of structures comprising rectangular guide segments placed alongside the filter body, which act as a shunt "stubs", so as to introduce transmission zeros in the response from the guide band-pass filter.

US-A-2009-0153272 discloses the use of resonant posts inside the band-stop filter, wherein such posts are spaced by coupling waveguide segments between the resonant posts themselves. The distance between the resonant posts is ¾ of the central wavelength of the band-stop filter stopband.

SUMMARY OF THE INVENTION

The applicant has noted that, with reference to the waveguide band-pass filters, the prior art does not offer any solutions which enable to achieve an increase in filter selectivity by not complex manufacturing procedures.

The problem on which the present invention is based is to provide an alternative waveguide band-pass filter in respect to those known and which, for example, allows an easy manufacturing, while offering good performances in terms of selectivity and keeping compact overall dimensions.

The above problem is solved by a band-pass filter as recited in the appended claim 1 and particular embodiments thereof as defined in the dependant claims 2 to 15.

BRIEF DESCRIPTION OF THE DRAWINGS

Some particular embodiments of the present invention are disclosed in detail below, as a way of example and not a limitation, with reference to the accompanying drawings, wherein.

DETAILED DESCRIPTION

Figure 1:
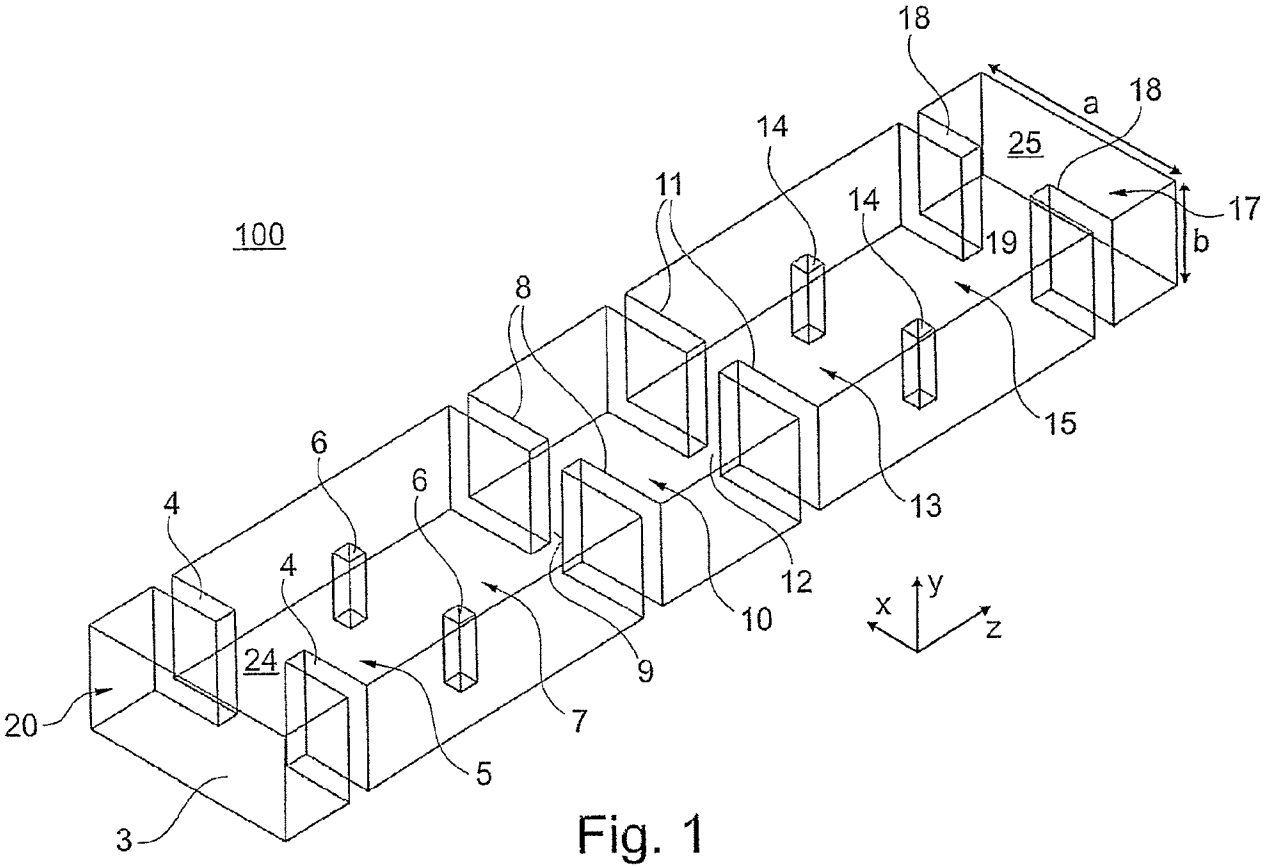
FIG. 1 shows an axonometric and schematic view of the inner structure of an example of a waveguide band-pass filter.
Figure 2:
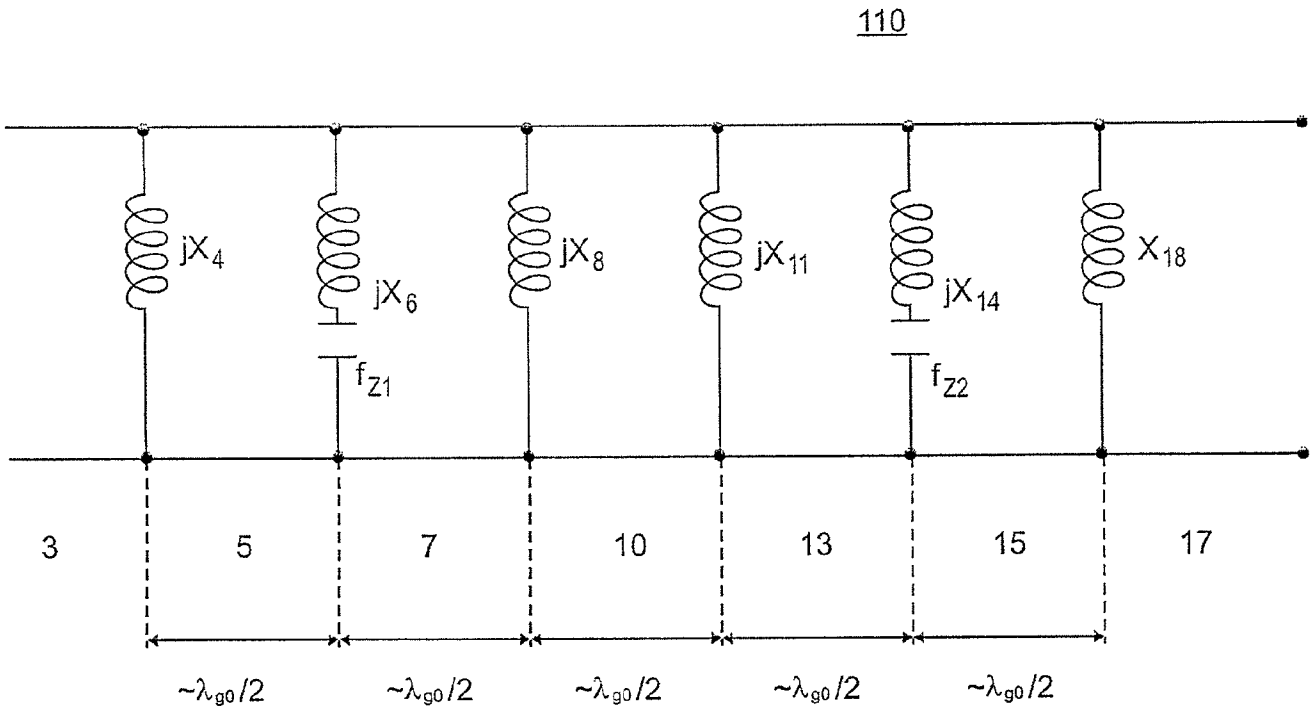
FIG. 2 shows an equivalent electrical scheme of the band-pass filter in FIG. 1 comprising inductive reactances and reactances associated to resonant discontinuities.

FIG. 1 schematically shows the inner structure of an exemplary band-pass filter which can be implemented in a waveguide 100. FIG. 2 shows the equivalent scheme 110 of the band-pass filter 100. To the band-pass filter 100 a pass-band B is associated having a central wavelength designated by $\lambda_{g0}$. The reciprocal band-pass filter 100 of FIG. 1, is of the order N=5 and has two transmission zeros.

The band-pass filter 100 can be made, according to an example, by means of a metal rectangular waveguide of dimensions a, along an axis x, and b, along an axis y. In more detail, the band-pass filter 100 comprises an input 3 for a signal (i.e. a radiation/electromagnetic wave) to be filtered, a first inductive discontinuity coupling device 4, connected to input 3, and a first waveguide 5 resonator segment, coupled to input 3 by the first coupling device 4.

As it is shown in FIG. 1, the input 1 is a waveguide segment having an input opening 20 which can be coupled, for example, to a radiation source or to a circuit in a waveguide by means of a flange (components not shown).

The first inductive discontinuity coupling device 4 can be made, according to a first embodiment, by means of an iris or inductive diaphragm comprising two metal septums (also referred to by reference numerals 4) arranged symmetrically in respect to a median longitudinal plane, which develops parallel to an axis z of the radiation propagation. The metal septums 4 of the first inductive diaphragm identify a first coupling radiation opening 24 of the electromagnetic field.

With reference to the equivalent electric scheme of FIG. 2, the first inductive diaphragm 4 is represented as an optimal shunt inductor having an inductive impedance $jX_4$. The walls of the first inductive diaphragm 4 have the same height as the height b of filter 100.

The first resonator segment of the waveguide 5 has a length, taken on the axis z, approximately equal to half of length of the central wave of the filter: $\lambda_{g0}/2$ and it is coupled to the input 3 by the inductive diaphragm 4. The resonator segment 5 can also have a length which is multiple of the value $\lambda_{g0}/2$.

Moreover, the first resonator segment 5 is coupled to a second resonator segment 7 by a first resonant coupling 6. The first resonant coupling device is a resonant coupling structure which introduces a discontinuity configured to introduce a zero in the transmission frequency response of the band-pass filter 100.

In more detail, the first resonant coupling device 6 is configured to resonate at a frequency equal to the value of the frequency of the zero being introduced in the transmitting response of the band-pass filter 100. In particular, such a transmission zero concurs to increase the selectivity of the filter in the higher and lower stop-bands of the filter 100 itself.

For different frequencies from the resonance frequency of the first resonant coupling device 6, the device itself behaves as a coupler. The position on the frequency axis of the transmitting zero can be determined by synthesis procedures known to those skilled in the art. The transmission zero corresponds, in a practical implementation of the filter 100, to an attenuation peak.

As it is visible in the example of FIG. 1, the first resonant coupling device 6 can be made by at least a body within the waveguide of the filter 100 and having a reduced height relative to height b of the waveguide itself. In particular, the first resonant coupling device 6 comprises two parallelepiped-shaped (for example, with a square base) posts, parallel oriented to axis y, arranged, for example, symmetrically relative to the median longitudinal plane and having a height h lower than dimension b.

Such first reduced-height posts 6 are schematically depicted in FIG. 2 as a shunt-arranged resonant circuit element and therefore as a series of an inductor and a capacitor with a total reactance X6 (with impedance $jX_6$). Such an impedance $jX_6$ results in the presence of a zero at the frequency fz1 in the transmission response of the band-pass filter 100.

Even if the first reduced-height posts 6 play a role as a resonant body, they act for different frequencies from the resonance frequency as a coupling device which, in conjunction with the first diaphragm 4, causes the first guide segment 5 to be a resonant cavity.

The second resonator segment 7, with a length equal to approximately half of the central wavelength of the filter (i.e. $\lambda_{g0}/2$) has an end (opposite the first posts 6) connected to a second inductive discontinuity coupling device 8. Such a coupling device 8 is analogous to the first device 4 and comprises a second inductive diaphragm which identifies a second opening 9 for radiating.

In the equivalent scheme 110 in FIG. 2, the second inductive discontinuity coupling device 8 is represented by another inductive shunt impedance $jX_8$.

The band-pass filter 100 further comprises a third resonator segment 10 with a length approximately equal to $\lambda_{g0}/2$, coupled to the second resonator segment 7 by the second inductive diaphragm 8.

According to the concerned example, the third resonator segment 10 is connected to a third inductive discontinuity coupling device 11 (analogous to the first coupling device 4), implemented by a further inductive diaphragm (impedance $jX_{11}$) provided with a third aperture 12.

The third resonator segment 10 is further coupled to a fourth resonator segment 13 (of a length $\lambda_{g0}/2$) connected to a second resonator coupling device 14, comprising two second reduced-height posts, and analogous to the first coupling device 6 and having an impedance $jX_{14}$.

The second reduced-height posts 14 are such to resonate, for example, at a different resonance frequency $f_{z2}$ and therefore they cause the presence of another zero in the transmitting frequency response of the band-pass filter 100, at the frequency $f_{z2}$. For example, the zero placed at frequency $f_{z1}$ increases the selectivity in the lower stop-band, while the zero at frequency $f_{z2}$ increases the selectivity of the higher stop-band at the pass-band B of the filter 100. For different frequencies from the resonance frequency $f_{z2}$ the second posts with a reduced height 14 act as a coupling device.

The fourth resonator segment 13 is coupled to a fifth resonator segment 15 (approximately $\lambda_{g0}/2$ long) by the second posts with a reduced height 14. The fifth resonant segment 15 is then coupled to an output 17 of the filter 100 by a fourth inductive discontinuity coupling device 18 implemented by a respective fourth inductive diaphragm having a fourth opening 19 and an inductive impedance $jX_{18}$.

According to the examples illustrated, the output 17 of the filter 100 is the waveguide segment which has an output opening 25 for providing the filtered signal and for being coupled to a load or to a further waveguide segment or to a further filter. It is to be observed that the resonant coupling devices 6 and 14 are arranged in respective regions of the filter 100 guide wherein the electric field has is at the minimum, in order not to degrade the figure of merit of the resonator guide segments 5, 7, 13 and 15 adjacent to such resonant coupling devices.

Dimensioning and Operation of the Filter

The dimensioning of the first, second, third and fourth inductive diaphragm 4, 8, 11 and 18, and the first and second reduced-height posts 6 and 14, is such that each of these devices acts as an impedance inverter around the central frequency of the filter 100. This causes the first, the second, the third, the fourth and the fifth guide segments 5, 7, 10, 13 and 15, approximately λgo/2 long, to act as resonant cavities around the central frequency $f_0$ of filter 100.

Even though in FIG. 1 only five resonant cavities are shown, the band-pass filter 100 may comprise a number N of cavities, equal to the filter order. In general, the filter 100 may comprise a plurality of resonant coupling structures in generally located (analogous to structures 6 and 14), in order to introduce in the band-pass response up to N+1 transmission zeros for a N-order filter.

The frequency value $f_{z1}$ of the first zero (e.g, lower than the mid-band frequency $f_0$ of the filter 100) and the frequency value $f_{z2}$ of the second zero (e.g, higher than the mid-band frequency f0 of the filter 100) may be suitably selected in the stop-bands within the whole operative band of the waveguide, i.e. from the cut-off frequency $f_c$ up to the value $2f_c$ and beyond.

Figure 3:
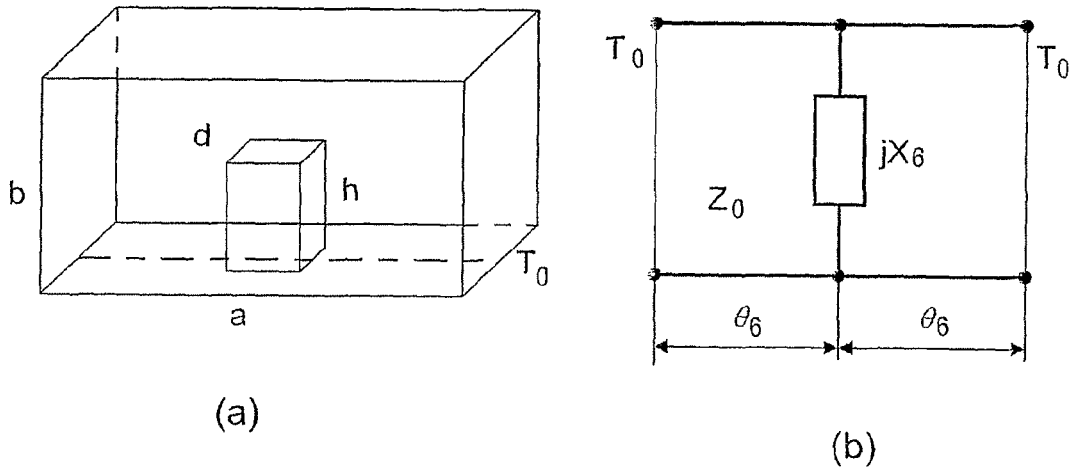
FIG. 3*a* shows an example of a reduced-height post usable in said filter.
FIG. 3*b* shows the equivalent electric circuit of said reduced-height post.

FIG. 3*a* shows an example of the first resonant coupling device 6, in the case of an individual square-base, reduced-height post with a side d and a height h, arranged so that it is centred in respect to the transversal cross-section of the waveguide where it is inserted. FIG. 3*b* shows the circuit equivalent to the first reduced-height post 6, comprising an impedance $jX_6$ parallel between two segments of the transmission line having length $\theta_6$, to which the following parameters are associated:

$X_6$ is the equivalent reactance of the reduced-height post 6;

Zo is, the characteristic impedance of two segments of the transmission line;

$\theta_6$ is the equivalent electric length of the two segments of transmission line;

To is the position of the reference sections in respect to which the equivalent circuit is defined.

The equivalent reactance $X_6$ and the electric length $\theta_6$ are related to the transmission parameters of the first reduced-height post 6 according to the following relations:

$$j\frac{X_6}{Z_0} = -\frac{1}{2}\frac{S_{21}}{S_{11}} \tag{1}$$

$$\theta_6 = -\frac{\pi + \angle(S_{11} - S_{21})}{2} \tag{2}$$

wherein $S_{11}$ is the reflectance and $S_{21}$ is the transmittance, both evaluated in respect to the To sections.

Figure 4:
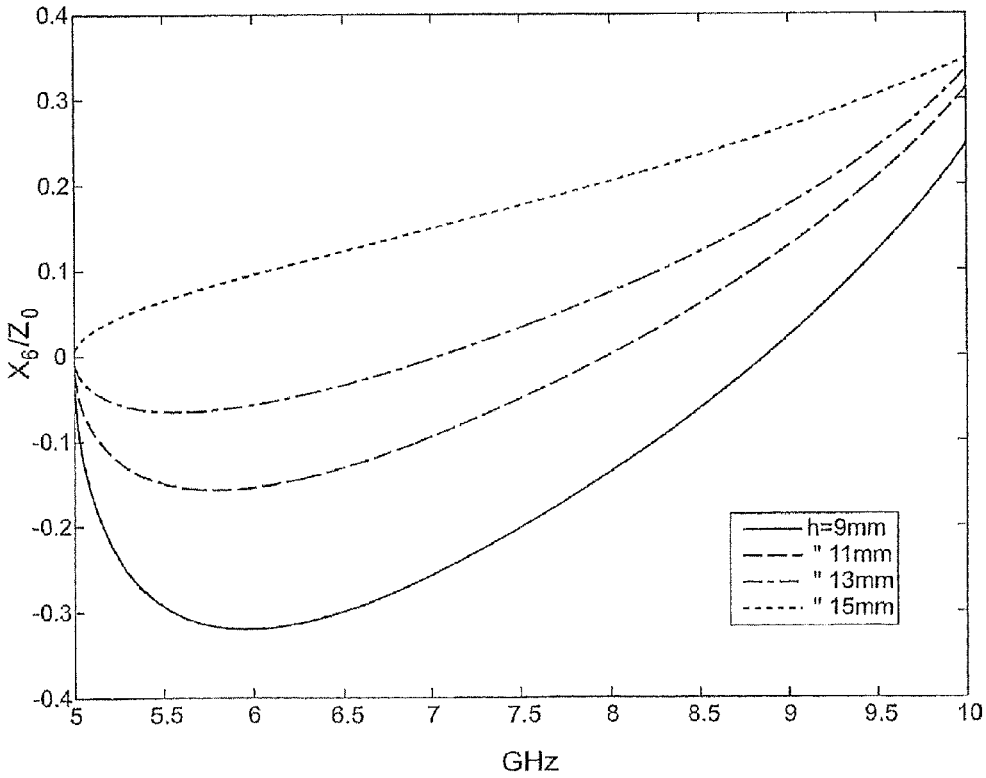
FIG. 4 shows behaviours of the reduced-height post reactance depending on frequency and for different values of its height.

For example, taking into account a guide having a=30 mm and b=a/2, the frequency dependence on the ratio $X_6/Z_0$ (normalised reactance) for the first reduced-height post 6 of FIG. 3*a*, was diagrammatically depicted in FIG. 4 for several values of height h=9, 11, 13 and 15 mm (side d=3 mm). For each value of h, the behaviour of the normalized reactance of the first reduced-height post 6 corresponds to a LC-series resonator around its own resonance frequency. Such a resonance frequency decreases when height h increases.

Figure 5:
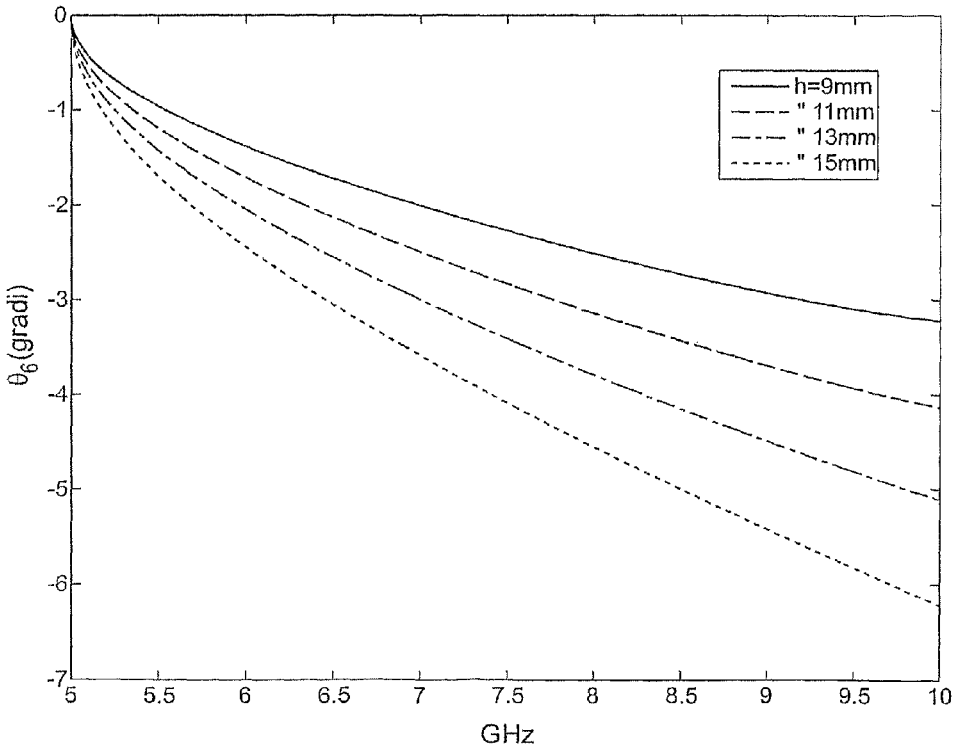
FIG. 5 shows behaviours of the electric length of the line equivalent to such a reduced-height post depending an frequency and for different values of its height.

Considering the same dimensional values, exemplarily denoted above, the frequency dependence of the equivalent length $\theta_6$ is diagrammatically depicted in FIG. 5, where both reference sections are arranged at the longitudinal symmetry plan of the first reduced-height post 6 (To in FIG. 3*a*). As it is seen in FIG. 5, the behaviour of the equivalent electric length $\theta_6$ is analogous to the one of a full-height post having an inductive behaviour; the slope of the electric length $\theta_6$ increases upon the increase of height h.

Figure 6:
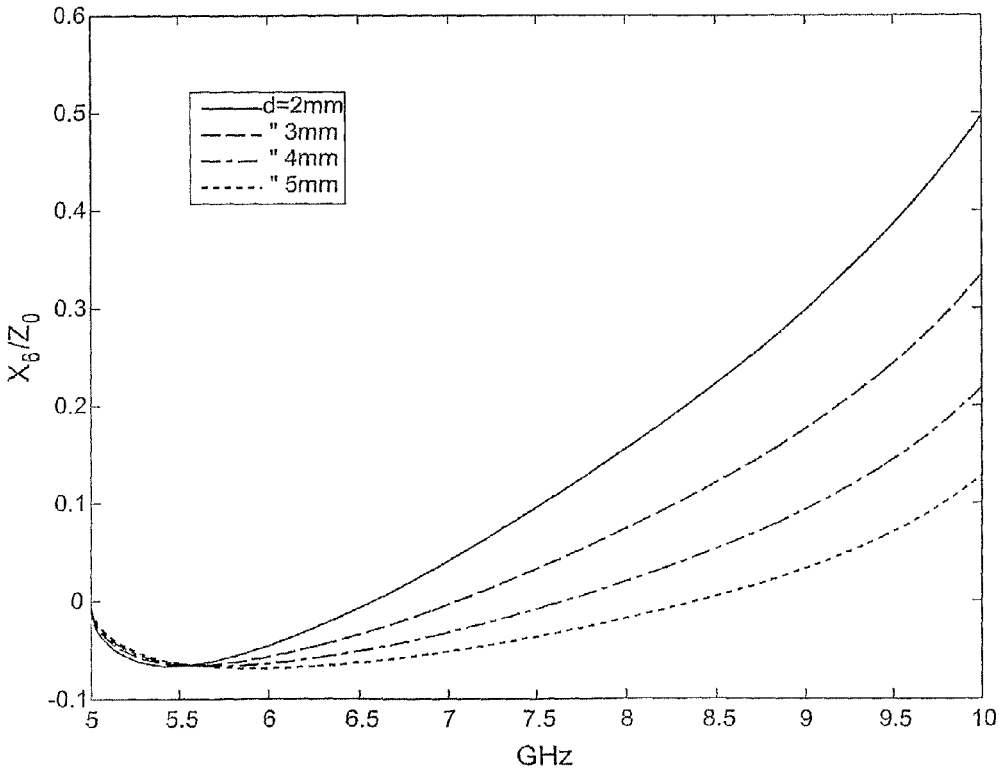
FIG. 6 shows behaviours of the electric length of the line equivalent to such a reduced-height post depending on frequency and for different values of its lateral dimension.

FIG. 6 shows the frequency dependence of the ratio $X_6/Z_0$ for several values of the side d=2, 3, 4 and 5 mm (height h=13 mm). However the resonance frequency and the behaviour of the ratio $X_6/Z_0$ with the frequency depend on both the height h and on the side d. This behaviour allows to use the reduced-height post 6 as a coupler between waveguide resonators and allows also the introduction of transmission zero.

By properly dimensioning the components of the band-pass filter 100 a transmission response may be obtained by the filter which is, for example, of the Chebyshev type, with transmission zeros (pseudo-elliptical response). Due to the presence of zeros, thus the band-pass filter selectivity can be increased (i.e. the attenuation in the higher and lower stop-bands at the pass-band) with the same number of resonators.

Figure 7:
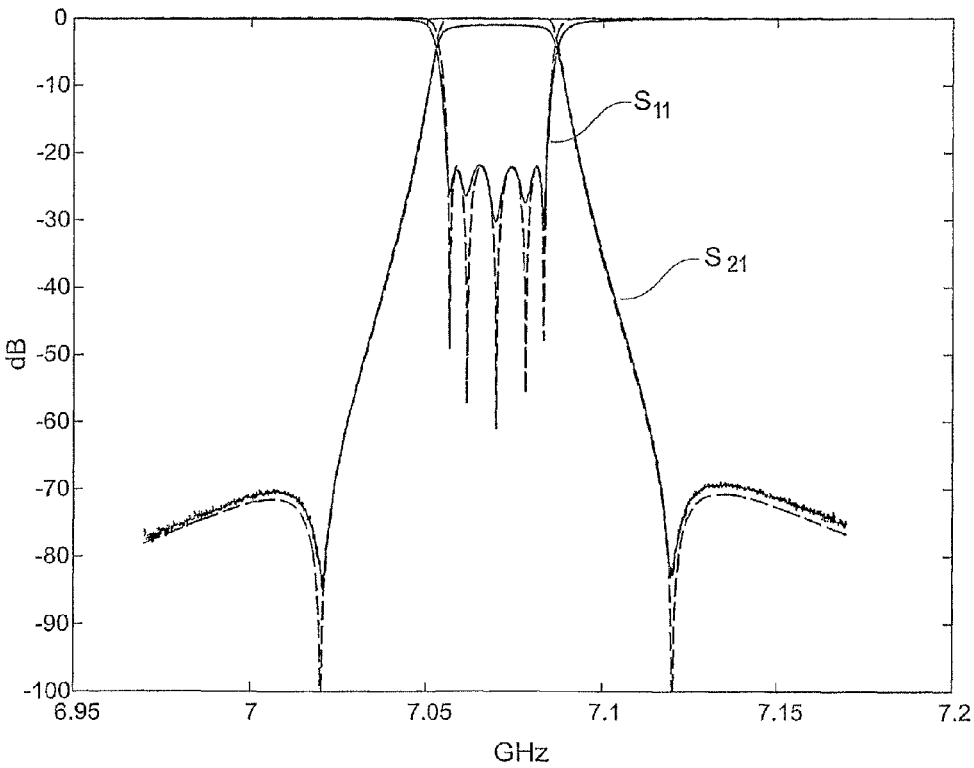
FIG. 7 shows the behaviour of the transmission coefficient S21 and of the reflection coefficient S11 experimentally measured on a band-pass filter analogous to that in FIG. 1 and also shows the behaviours of said coefficients obtained by means of simulation.

FIG. 7 illustrates the behaviour of transmittance $S_{21}$ and reflectance experimentally measured on a band-pass filter analogous to that in FIG. 1, schematically depicted in FIG. 2, implemented with a waveguide and having two transmission zeros (corresponding in the practice to attenuation peaks). The experiments were carried out on a filter made by the Applicant in a R70/WR137 guide, having inner dimensions equal to 34.85 mm×15.799 mm, using silvered aluminium. The project was carried out according to the following specifications a central frequency $f_0$=7.070 GHz;

a bandwidth B=28 MHz;

a level of the band return loss of 22 dB;

order N=5;

two transmission zeros (corresponding in practice to attenuation peaks) located at frequencies $f_{z1}$=7.020 GHz (in the lowest stop-band) and $f_{z2}$=7.120 GHz (in the highest stop-band).

The experimental results shown in FIG. 7 (solid lines) perfectly match those provided by the simulation (dashed lines).

As to the operation, an electromagnetic wave in the form of, the mode $TE_{10}$ (basic mode in a rectangular guide) affects the input 3. The electromagnetic wave propagates along the axis z of the filter 100, being partially reflected at the input 3 and partially transmitted at the output 17, according to the frequency of the wave itself.

When passing through the filter 100 the electromagnetic wave with a frequency comprised within the pass-band B of the filter itself interacts with the resonances of the resonant segments 5, 7, 10, 13, and 15 and, due to the coupling devices 4, 6, 8, 11, 14 and 18, it is transmitted to the output 17 with a reduced reflection at the input 3. The electromagnetic wave with a frequency outside the pass-band of the filter 100, instead, undergoes reflections within the filter and therefore it is substantially stopped, to an extent which depends on the difference between the wave frequency and the filter central frequency.

The electromagnetic wave having a frequency equal to one of the resonance frequencies of the two resonant coupling devices 6 and 14, in particular, is totally reflected at input 3 (with a null transmission at the output 17, giving rise to an attenuation peak) as the effect of the short-circuit created along the guide by the resonant coupling devices.

Further Embodiments

Figure 8A:
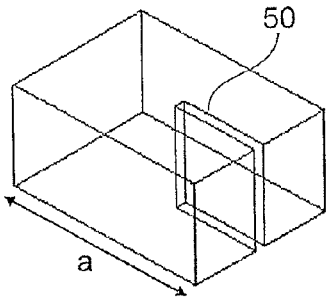
FIG. 8*a* shows an example of an inductive coupling device made by a full-height septum (asymmetric inductive iris)
Figure 8B:
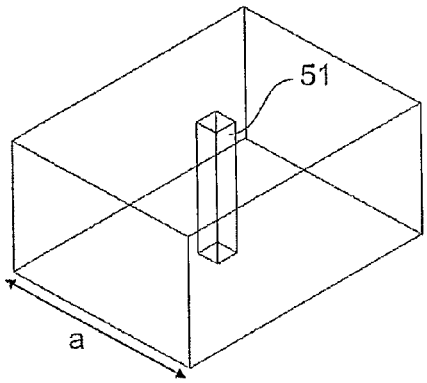
FIG. 8*b* shows another example of an inductive coupling device made by an individual full-height post with a square base.

It is to be observed that according to other embodiments, each of the inductive diaphragms described above may be made not by the pairs of symmetrical septums 4, 8, 11 and 18 shown in FIG. 1, but by the following alternative modes:

an asymmetrical inductive iris, comprising an individual full-height septum 50 (FIG. 8*a*);

a full-height inductive post 51 (FIG. 8*b*): the post may be centred, or not, have a rectangular, circular or other base; there can be one or more full-height inductive posts 51.

Figure 8C:
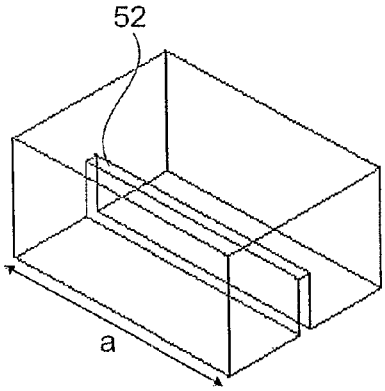
FIG. 8*c* shows a capacitive coupling device made by a full-width septum (asymmetric capacitive iris)

Moreover, instead of an inductive diaphragm, an asymmetrical capacitive iris can be used as a (non-resonant) coupling device, comprising a reduced-height, full-width septum 52 (FIG. 8*c*). Also a symmetrical capacitive iris may be used, comprising another reduced-height, full-width septum.

Figure 9A:
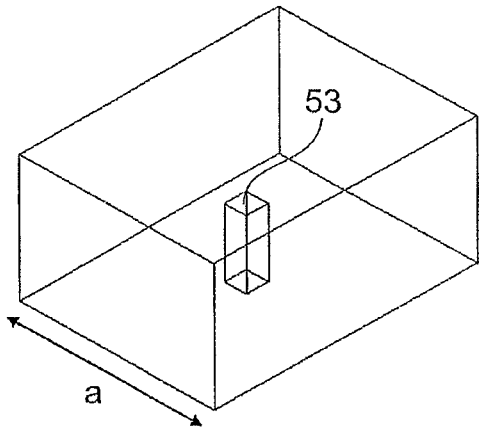
FIG. 9*a* shows an example of a resonant coupling device made by an individual reduced-height post with a square base.
Figure 9B:
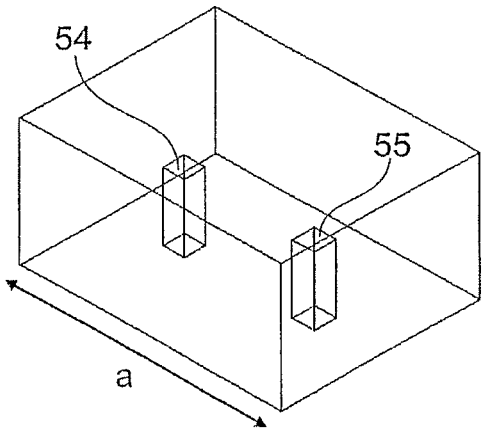
FIG. 9*b* shows another example of resonant coupling device made by two reduced-height posts with a square base.

Moreover, each of the resonant coupling devices 6 and 14 may be implemented, as an alternative to the embodiment in FIG. 1, by one or more full-height posts having different forms (for example, with a rectangular, square, circular or other base). For example, FIG. 9*a* shows an individual reduced-height post 53 with a square plan, while FIG. 9*b* shows a pair of reduced-height posts 54 and 55.

It is to be observed that the illustrated geometries are only exemplary; and also a pair of reduced-height posts may be used wherein one is secured to the top wall of the filter 100 guide and the other is secured to the bottom wall of the same guide, or wherein the post are differently shaped and sized in respect to each other.

Figure 10:
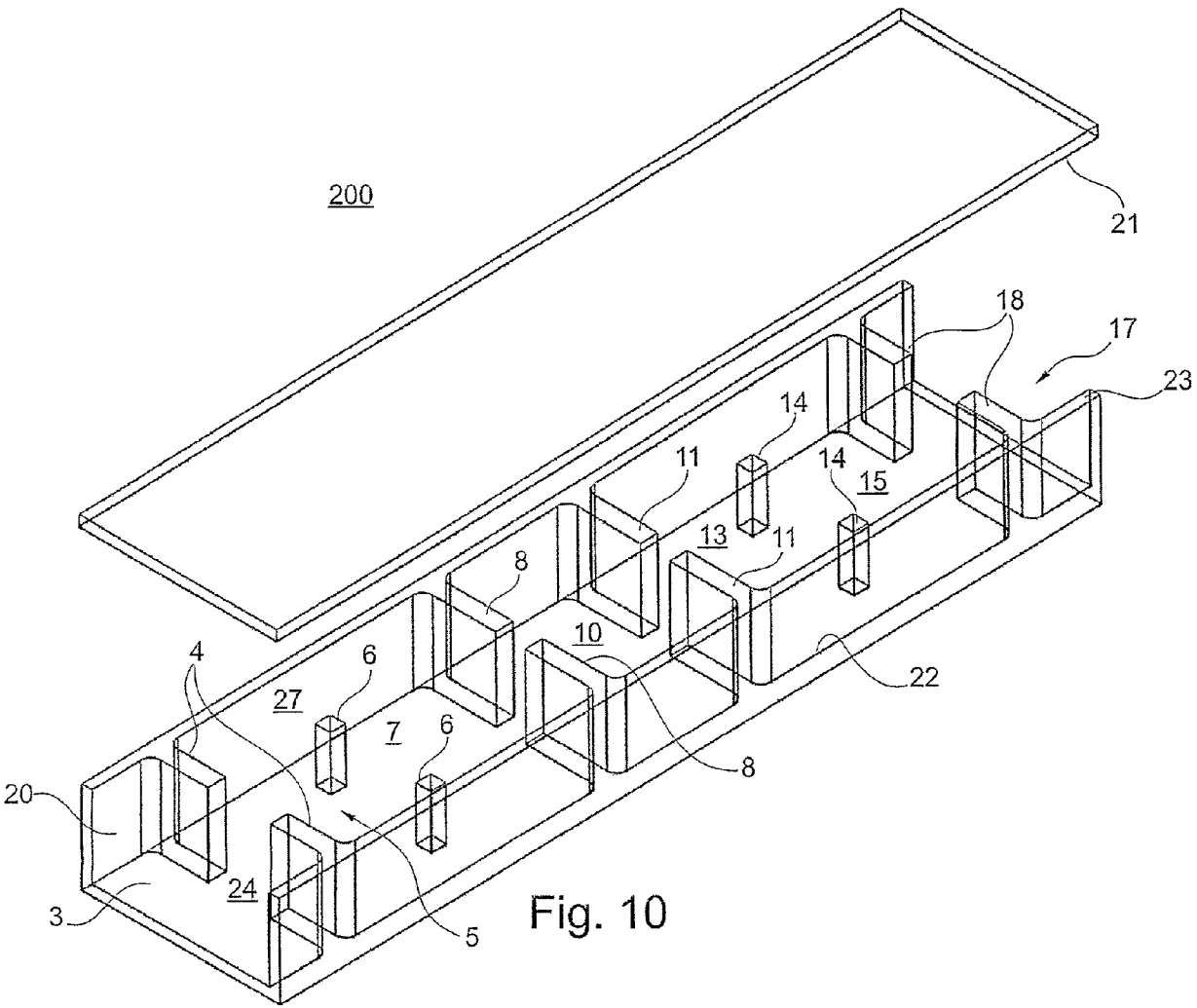
FIG. 10 shows an exploded view of a first embodiment of the band-pass filter of FIG. 1 which can be made by milling.

FIG. 10 shows a first embodiment of the filter of FIG. 1 comprising a waveguide 200 provided with a top wall 21 facing a bottom wall 22 and a first side wall 23, facing a second side wall 27. In the Figures, the same reference numerals refer to the same or analogous components or devices.

The waveguide 200 of FIG. 10 can be obtained by processing an individual metal slug (corresponding to the bottom of the waveguide 200, which comprises the bottom wall 22), for example, by milling steps (which can be carried out by Numeric Controlled machines) which allow, by removing the material, to form the bodies which form the inductive/capacitive or resonant discontinuities present in the waveguide 200. The rounding offs within the waveguide 200, shown as a way of example in FIG. 10, refer to the particular use of a candle-mill.

Figure 11:
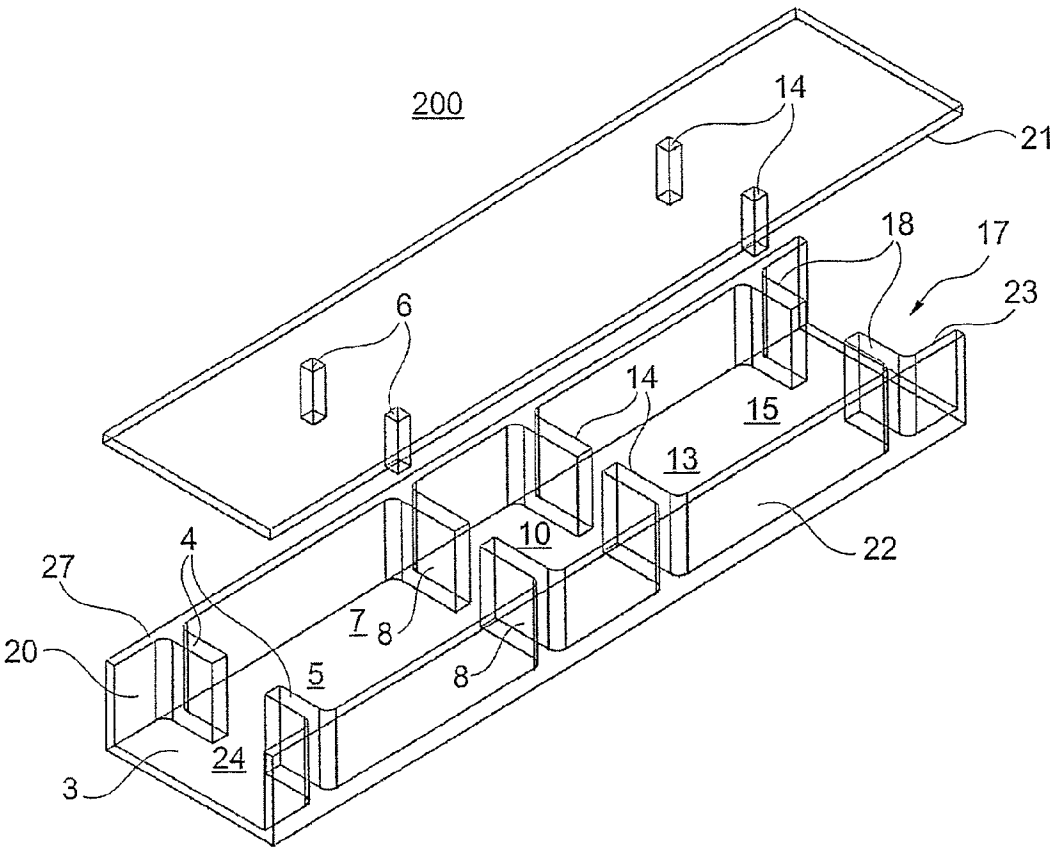
FIG. 11 shows an exploded view of a second embodiment of the band-pass filter of FIG. 1 which can be made by milling.

FIG. 11 illustrates an analogous embodiment to that of FIG. 10, which requires, however, two slugs, one for the top wall 21 integral with the reduced-height posts 6 and 14, and one for the bottom of the guide 200, integral with the bottom wall 22. The embodiment of FIG. 11 has an advantage, in respect to that of FIG. 10, in terms of manufacturing process when the distances between the reduced-height posts 6 and 14 and the side walls 23 and 27 are smaller than the minimum diameter of the mill.

Figure 12:
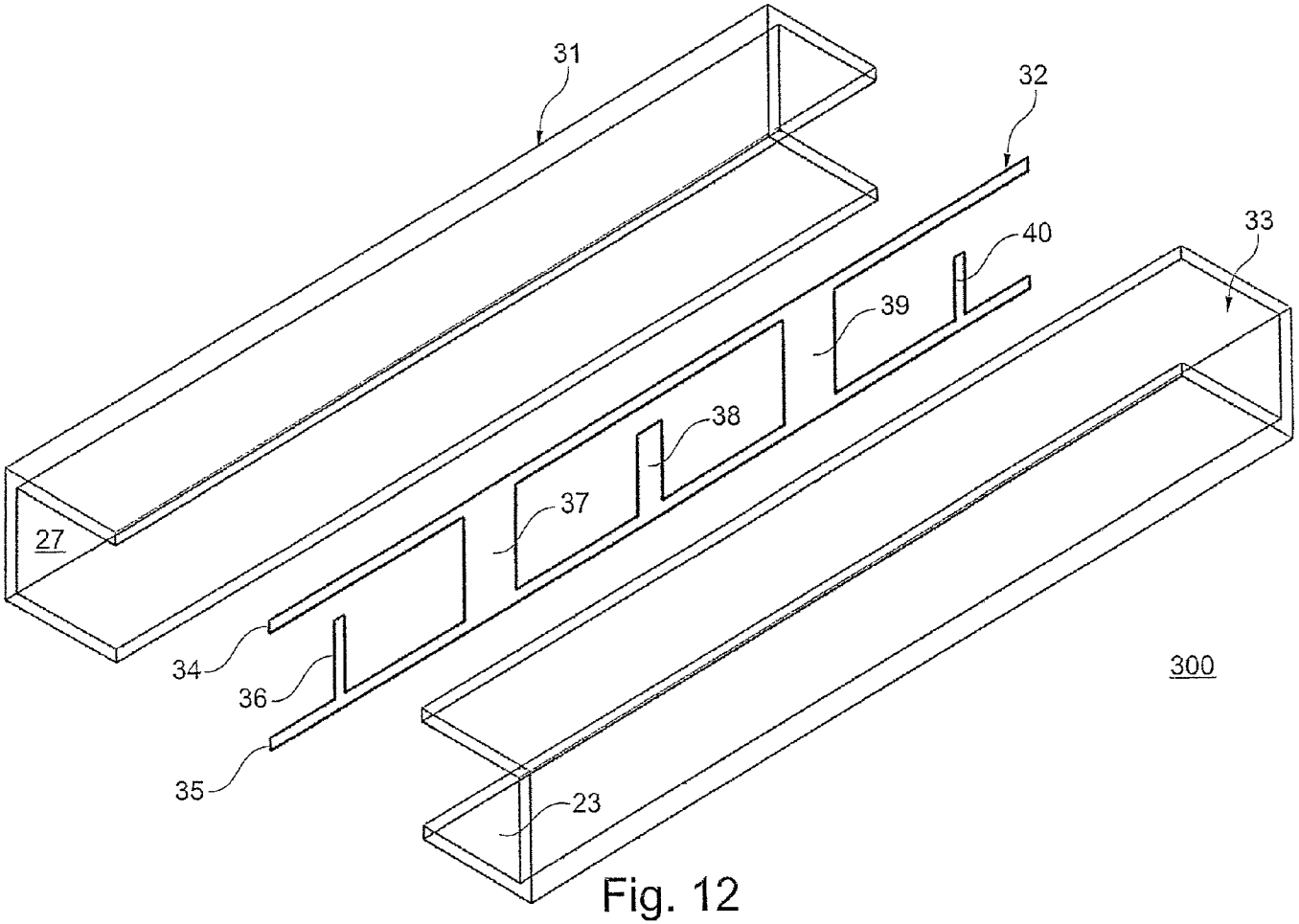
FIG. 12 shows an exploded view of a third embodiment of the band-pass filter of FIG. 1 which can be made by the metal insert technique.

FIG. 12 refers to another embodiment 300 of the "metal insert-type" band-pass filter 100, which is an alternative to those of FIGS. 10 and 11. In FIG. 12, the metal-insert type band-pass filter 300 is made by assembling (for example by welding or the like) a first guide shell 31, a structure 32 and a second guide shell 33, all made of metal. The first and the second guide shells 31 and 33, when assembled, form a rectangular wave guide.

The structure 32, intended to be placed in the middle of the wave guide and parallel to the axis of propagation z comprises a carrying longitudinal top laminar rod 34 and a carrying longitudinal bottom laminar rod 35, between which a plurality of laminar discontinuity bodies extend.

In particular, the structure 32 comprises a first reduced-height laminar body 36, a first full-height laminar body 37, a second reduced-height laminar body 38, a second full-height laminar body 39 and a third reduced-height laminar body 40.

The operation and the equivalent electric scheme of the filter in FIG. 12 are analogous to those disclosed above and therefore the full-height laminar bodies 37 and 38 have the function of inductive coupling devices, while the reduced-height laminar bodies 36, 38 and 40 are resonant coupling devices (from the circuit perspective, analogous to the reduced height posts 4) and adapted for introducing a respective transmission zero.

The four guide segments interposed between consecutive laminar bodies 36, 37, 38, 39 and 40 are segments intended to operate as resonators within the pass-band. It is to be noted that also two plates, analogous to plate 32, may be used, each one having the plurality of discontinuities indicated above, which will be arranged, preferably, symmetrically in respect to a longitudinal middle plane of the assembled waveguide.

The embodiment shown in FIG. 12 is particularly advantageous since it provides a simple and quite inexpensive manufacturing method based on working the plate 32, which provides removing metal portions, for example, by laser cutting or electro-erosion.

Figure 13:
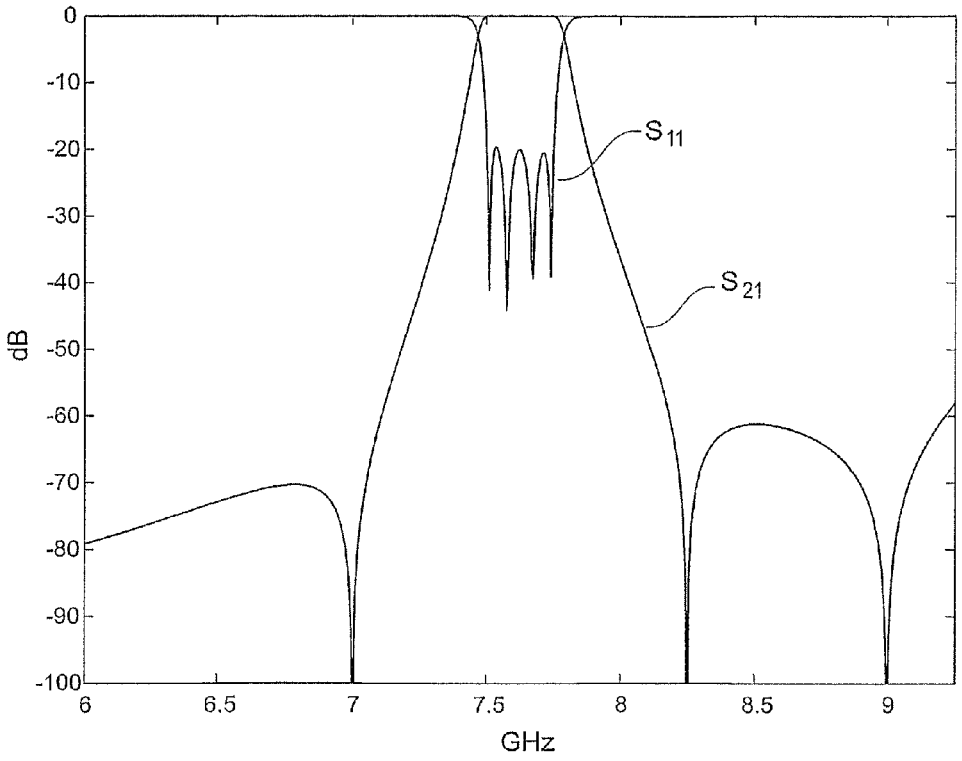
FIG. 13 shows the behaviour of the transmittance S21 and reflectance S11 obtained by simulation relative to a band-pass filter analogous to that in FIG. 12.

The metal-insert band-pass filter 300 of FIG. 12 is a four-resonator filter with three transmission zeros. FIG. 13 shows the behaviours of the reflectance S11 and the transmittance S21 obtained by numerical simulation, referring to an example of the metal insert filter 300 of FIG. 12 with a guide dimension of 30×15 mm; pass-band 7.50-7.75 GHz, return losses 20 dB, three zeros at the following frequencies: 7 GHz, 8.25 GHz and 9 GHz.

As it is evident to those skilled in the art, the alternating inductive coupling devices in respect to the resonant coupling devices may follow a different order from those disclosed and designated as a way of example in the accompanying Figures. Furthermore, it is to be noted that according to a variant of the filter 300 of FIG. 12, instead of metal lamina 32 a thin metallised dielectric plate may be used, from the processing thereof the above disclosed coupling devices being obtained ("E-plane filters" technique).

Figure 14:
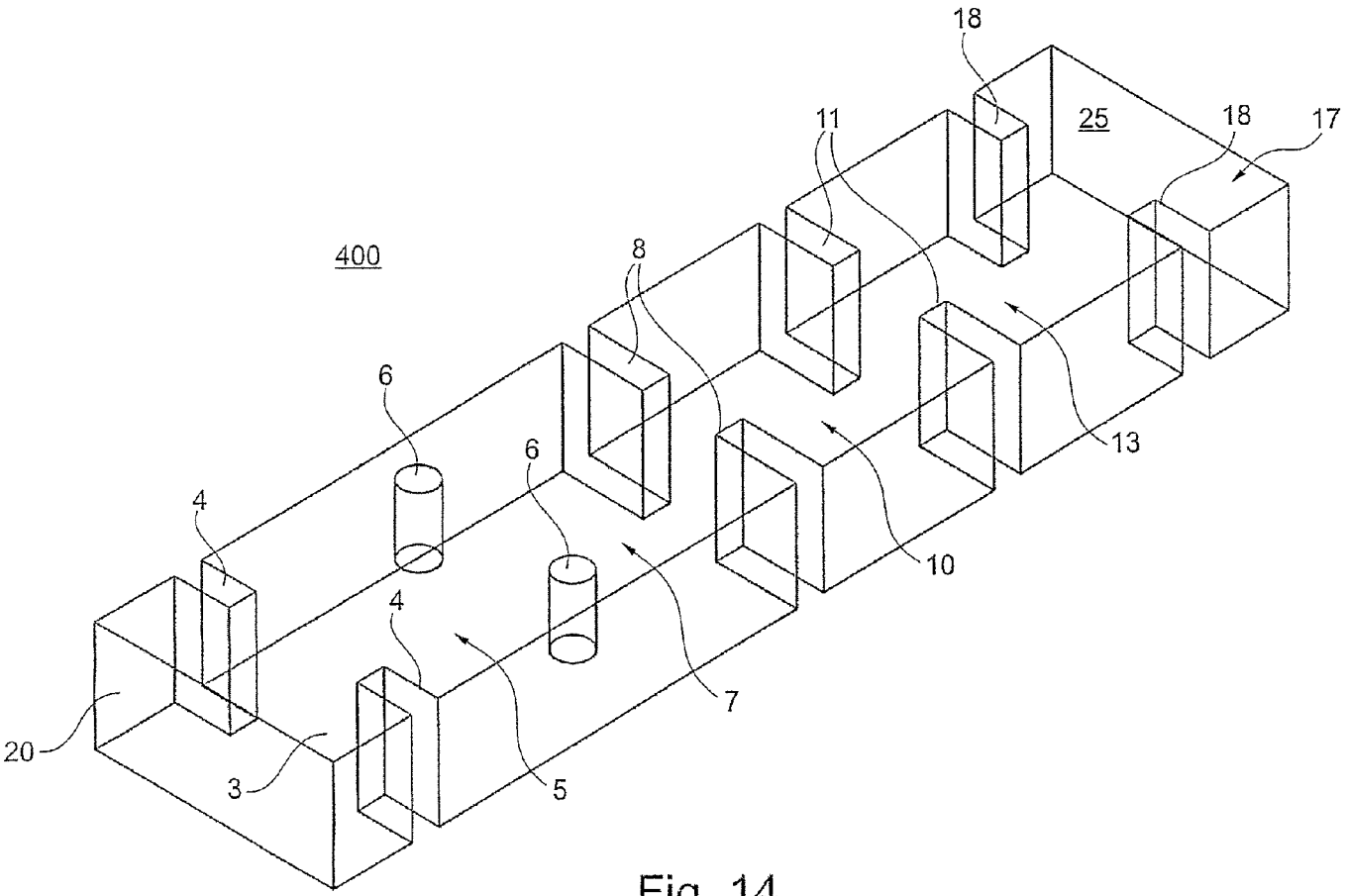
FIG. 14 shows the inner structure of a fourth embodiment of the band-pass filter of FIG. 1 of a dielectric type.

FIG. 14 refers to an embodiment 400 of the band-pass filter 100, which may be implemented by processing the low-loss dielectric slug, and suitable for the guided propagation of electromagnetic waves, obtaining hollow geometrical shapes which reproduce as a negative both the shape of the inductive coupling devices such as the diaphragms 4, 8, 11 and 18 and the resonant coupling devices (such as the two posts 6).

These cavities obtained in the dielectric slug are then coated with a metal material by a metallization step, which enables to obtain the four external walls of the waveguide of the dielectric filter 400. In particular, the dielectric-type filter 400 of FIG. 14 is a four-resonator band-pass filter with a transmission zero. For the sake of clarity of the depiction in FIG. 14, they are not shown.

Figure 15:
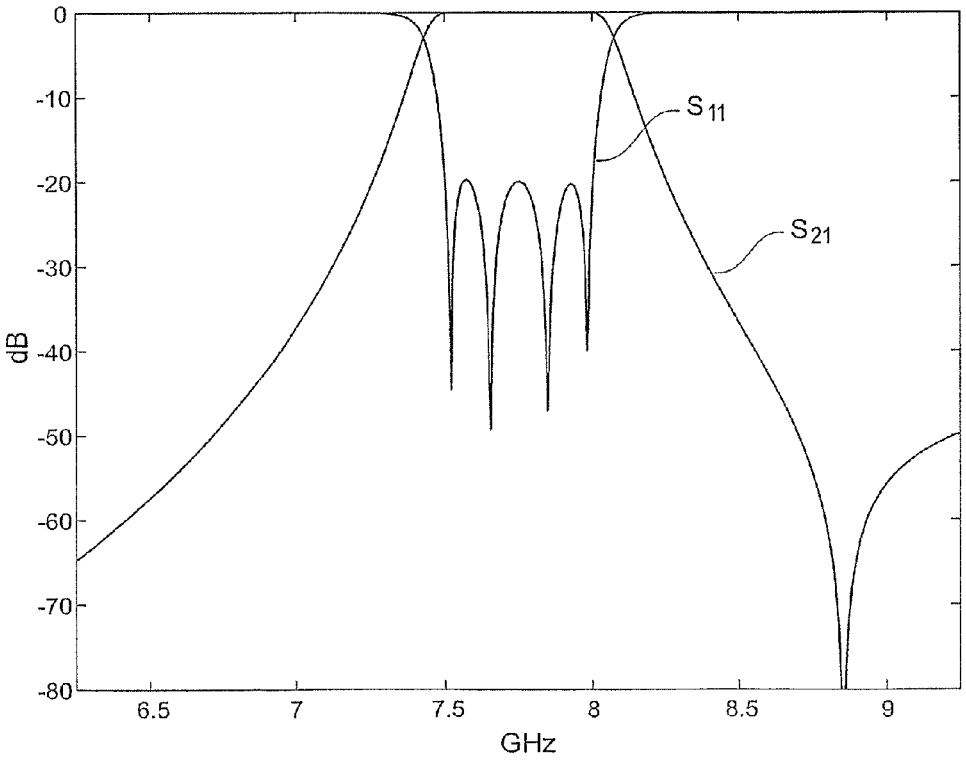
FIG. 15 shows the behaviour of transmittance S21 and reflectance S11 obtained by simulation relative to a band-pass filter analogous to that in FIG. 14.

FIG. 15 shows the behaviours of the reflectance S11 and transmittance S21 obtained by a numerical simulation with reference to an example of the dielectric filter 400 of FIG. 14, made of quartz, of 15×7.5 mm; pass-band 7.5-8.00 GHz, return loss 20 dB, a zero at 8.85 GHz.

The band-pass filter 100 and its different embodiments disclosed above, with reference to the several appended figures, may further comprise adjusting screws (not shown since they are known to those skilled in the art) which allow to carry out a fine calibration by compensating possible process tolerances.

The band-pass filter 100 may be used in waveguides which operate at the typical microwave frequencies, for example at frequencies ranging from 100 MHz and 40 GHz.

The disclosed band-pass filter is advantageous since it allows to obtain a remarkable increase in the selectivity in respect to the prior art filters, with the same number of resonators, and at the same time it may be implemented quite simply, with similar size and losses, and according to the different technologies currently available. A particular advantage is due to the possibility to implement also the resonant coupling devices by bodies within the guide itself.

Finally, the present invention is capable of a number of modifications and variants, all of which fall within the appended claims, whereas the technical details can change according to specific needs.

The invention claimed is:

1. A waveguide band-pass filter comprising:

an input/output gate for a signal;

a first inductive discontinuity coupling device;

a second inductive discontinuity coupling device;

a first waveguide resonator segment coupled to said input/output gate for a signal and interposed between the first and the second coupling devices;

wherein:

the first and the second coupling devices include at least a resonant coupling structure which extends in the waveguide with a reduced height in respect to a height of the first resonator waveguide segment and it is shaped for introducing a zero in a transmission frequency response of the filter, and the first and second coupling devices are structured to operate as coupling devices at frequencies of said signal different from a resonance frequency of the at least a resonant coupling structure.

2. The band-pass filter according to claim 1, wherein said at least a resonant coupling structure is such as to resonate at said resonance frequency equal to the frequency value of said zero of the transmission frequency response of the band-pass filter.

3. The band-pass filter according to claim 2, wherein said at least one resonant coupling structure is configured in such a way that to said zero an attenuation peak of the filter is associated in the transmission response.

4. The band-pass filter according to claim 1, wherein said at least one resonant coupling structure comprises at least a reduced-height post.

5. The band-pass filter according to claim 1, wherein:

at least one of said first and second coupling devices is an inductive discontinuity device and comprises, preferably, at least a full-height body having a height equal to the first waveguide resonator segment height, or at least one of said first and second coupling devices is an capacitance discontinuity device and comprises, preferably, at least a full-width, reduced-height body in respect to the first waveguide segment height.

6. The band-pass filter according to claim 1, wherein the filter is implemented in one of the following modes: metal waveguide, metal insert waveguide, E-plane type waveguide, dielectric guide with metal coating.

7. The band-pass filter according to claim 1, wherein the filter is implemented in a rectangular waveguide.

8. The band-pass filter according to claim 1, wherein the length of the first resonator waveguide segment is substantially equivalent to the distance between the first and the second coupling devices and it is substantially equal to half of a central wavelength of a pass-band of the filter or multiples thereof.

9. The band-pass filter according to claim 4, wherein said at least one resonant coupling structure extends perpendicularly to a propagation direction of a radiation associated with the signal and parallel to the direction of the electric field of said radiation.

10. The band-pass filter according to claim 5, wherein said full-height body comprises at least one of the following devices: at least a post, at least a symmetrical iris, at least an asymmetrical iris.

11. The band-pass filter according to claim 7, wherein the filter is implemented in a rectangular waveguide and it is sized for propagating and filtering the signal, which propagates according to the electric transverse basic mode and wherein said first input/output gate, the first coupling device, the first resonator segment, the second coupling device are subsequently arranged and aligned along a direction of propagation of said electric transverse basic mode.

12. The band-pass filter according to claim 1, further comprising:

a second resonator segment coupled to the second coupling device; and a third discontinuity coupling device connected to said second segment and provided with an output for the radiation.

13. The band-pass filter according to claim 1, further comprising at least a further resonant coupling structure which extends in the reduced-height waveguide in respect to the height of the guide segments and which is configured to introduce a further attenuation zero in the frequency response of the filter.

14. The band-pass filter according to claim 5, wherein said coupling devices are obtained by processing a metal or metallised dielectric lamina secured to shells forming the waveguide.

15. The band-pass filter according to claim 1, wherein the first and the second resonator waveguide segments are such that they resonate at frequencies within the pass-band of the band-pass filter.

* * * * *